United States Patent [19]

Berzlapa

[11] 3,998,194

[45] Dec. 21, 1976

[54] SYSTEM FOR CONTROL OF EXHAUST GAS RECIRCULATION

[75] Inventor: Juris Berzlapa, Hazelwood, Mo.

[73] Assignee: ACF Industries, Incorporated, St. Louis, Mo.

[22] Filed: Sept. 4, 1975

[21] Appl. No.: 610,101

[52] U.S. Cl. ..... 123/119 A

[51] Int. Cl.[2] ..... F02M 25/06

[58] Field of Search ..... 123/119 A; 60/278, 279

[56] References Cited

UNITED STATES PATENTS

| | | | |
|---|---|---|---|
| 3,739,797 | 6/1973 | Caldwell | 123/119 A X |
| 3,774,583 | 11/1973 | King | 123/119 A |
| 3,818,880 | 6/1974 | Dawson et al. | 123/119 A |
| 3,861,642 | 1/1975 | Maddocks | 123/119 A |
| 3,878,823 | 4/1975 | Vartanian | 123/119 A |
| 3,884,200 | 5/1975 | Caldwell | 123/119 A |
| 3,896,777 | 7/1975 | Masaki et al. | 123/119 A |
| 3,915,136 | 10/1975 | Caldwell | 123/119 A |
| 3,924,589 | 12/1975 | Nohira et al. | 123/119 A |
| 3,926,161 | 12/1975 | Wertheimer | 123/119 A |

FOREIGN PATENTS OR APPLICATIONS

| | | | |
|---|---|---|---|
| 1,601,374 | 10/1967 | Germany | 123/119 A |

*Primary Examiner*—Wendell E. Burns

[57] ABSTRACT

In an automotive internal combustion engine, metered quantities of exhaust gases are recirculated by way of a control valve to the intake manifold of the engine in order to control temperatures within the combustion chambers, thereby reducing formation of oxides of nitrogen. The control or metering valve is actuated by a vacuum motor which may be in the form of a diaphragm and which vacuum motor is actuated by vacuum signals derived from a pair of ports in the carburetor which supplies the air-fuel mixture to the engine. Vacuum signals are picked up at each of the two ports in the carburetor and merged by way of a single conduit to the vacuum motor chamber of the control valve. Location of the ports and calibrated restrictions within the conduits regulate the control of the metering valve.

4 Claims, 5 Drawing Figures

SYSTEM FOR CONTROL OF EXHAUST GAS RECIRCULATION

BACKGROUND OF THE INVENTION

If it were possible to have perfect combustion of a hydrocarbon fuel in an automotive internal combustion engine, the only products of such combustion would be carbon dioxide and water. These products have not been found to be harmful. Unfortunately, such perfect combustion is seldom realized and the exhaust gases from a typical internal combustion engine contain various quantities of unburned hydrocarbons, carbon monoxide and oxides of nitrogen. Because of the indeterminate and transitory nature of the nitrogen oxides, these are commonly referred to as NOX. Formation of oxides of nitrogen is enhanced whenever temperatures within the combustion chambers are high. Reduction of the temperature of combustion can be achieved by injecting an inert gas into the air-fuel mixture which enters the individual cylinders of the engine. The introduction of such inert gases results in a reduction of the peak temperatures achieved during the burning process and therefore a reduction in the quantity of NOX produced.

As pointed out above, an inert gas is useful in overcoming the problems associated with excessive production of oxides of nitrogen. Since it is undesirable to use a separate source of inert gases, it is fortunate that the products of combustion in the exhaust system of the vehicle contains the necessary components to make these exhaust gases qualify as an inert gas. Accordingly, the industry has made use of the exhaust gases to reduce NOX emissions. A variety of systems have been used to introduce exhaust gases into the intake manifold of the engine and these range from a simple opening between the exhaust manifold and the intake manifold with no control whatsoever, to somewhat complex control mechanisms that derive a control signal from the carburetor and utilize this signal to, in some manner, control a diaphragm-actuated valve to control the admission of exhaust gases in a regulated manner.

It has been found that it is undesirable to have exhaust gas recirculation into the intake manifold of the engine during certain modes of operation. For example, engine idle may be adversely effected with exhaust gas recirculation and, therefore, some vehicles have been equipped in such a manner that no exhaust gas is injected into the intake during engine idle conditions. Also, the injection of exhaust gases during peak power requirements may reduce the power available and, again, this has been found to be undesirable. Accordingly, some of the systems in present day use will shut off exhaust gases during engine idling and/or during wide open throttle high power conditions. To do this, some exhaust gas recirculation systems have installed a port in the body of the carburetor just above the throttle valve so that when the throttle is at the idle position, no vacuum signal is available to operate the diaphragm valve. Upon opening the throttle slightly, the manifold vacuum is made available by uncovering the port and this, in turn, opens the recirculation valve. Another system in use has been to provide a port in the vicinity of the venturi throat of the carburetor. This signal is weak at low flow rates and becomes stronger as air flow increases. The first system just described does not control the shut-off as well at high flows as may be desirable and the second system operates best at high air flow volumes and, therefore, does not shut-off at high air flow.

BRIEF DESCRIPTION OF THE INVENTION

According to the present invention, a pair of ports are provided in the body of a carburetor with one of the ports being located at or near the top side of the carburetor throttle valve when the throttle valve is in the idle position and the second port being provided in the vicinity of the greatest constriction in the venturi area of the carburetor. Each of these ports then senses a subatmospheric pressure during at least a portion of the normal operating range of the carburetor. The subatmospheric pressure sensed by the two ports is thus converted into a pair of signals and the two separate signals are merged to create a resultant signal which is applied to one side of a diaphragm motor which opens or closes a recirculation valve to control the quantity of exhaust gases recirculated. The resultant signal, by appropriate use of restrictions in the vicinity of the two ports, can be shaped and controlled so that the exhaust recirculation valve will be closed at normal idle conditions and will be opened during most normal cruise and part throttle conditions and yet can be closed at wide open throttle.

DETAILED DESCRIPTION OF THE INVENTION

Figure 1:
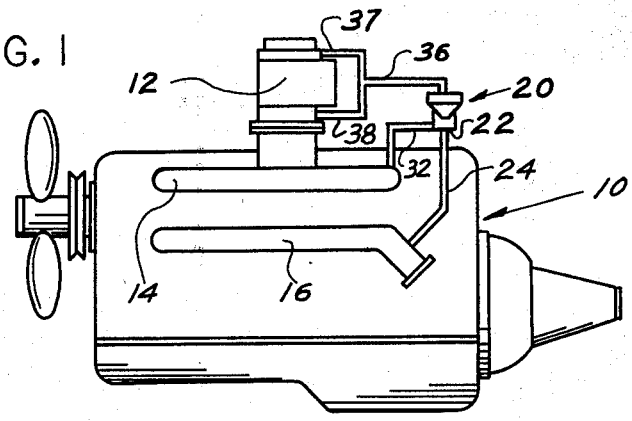
FIG. 1 is a representation of an engine having a carburetor, intake and exhaust manifolds, an exhaust gas recirculation valve and piping to illustrate the invention.

In FIG. 1 an internal combustion engine 10 is shown. The engine is provided with a carburetor 12, an intake manifold 14 and an exhaust manifold 16. An exhaust gas recirculation valve 20 has a port 22 connected by way of a pipe 24 to the exhaust manifold 16. A second Port 30 is connected by way of a pipe 32 to the intake manifold 14. A sensing line 36 is attached and in communication with the upper side of the exhaust gas recirculation valve 20 and the sensing line 36 has branches 37 and 38 which communicate with the carburetor as will be explained more fully hereinafter.

The exhaust gas recirculation valve 20 includes a flexible diaphragm member 40 which is enclosed by an upper diaphragm housing 42 and a lower housing 44. Upper housing 42 also encloses a biasing spring 43 which urges the diaphragm in a downward or valve closing position. Lower housing 44 is cut away at one or more openings 45 to communicate the interior of housing 44 with ambient air outside the valve. Housing 44 has a closure plate 46 to separate the housing 44 from a valve chamber 48. Closure plate 46 is provided with an upwardly turned sealing sleeve 47 to essentially eliminate movement of air or exhaust gases between the chamber 48 and the space enclosed within the lower housing 44. A valve stem 50 is attached to the diaphragm 40 and moves up and down in accordance with movement of diaphragm 40. At its other end, valve stem 50 is provided with a valve head 52 which closes and opens port 22 thereby allowing flow of exhaust gases from the manifold 16 through pipe 24 into the valve space 48. When valve head 52 is off its seat, thereby opening port 22, exhaust gases may flow through pipe 24 into space 48 and out pipe 32 to the intake manifold 14 as shown.

Since atmospheric pressure is normally present in the lower diaphragm housing 44, this pressure is exerted against one side of diaphragm 40. Since biasing spring 43 urges diaphragm 40 in a downward position, valve head 52 can move away from its seat only in the presence of a negative pressure in pipe 36. The amount that valve head 52 moves away from its seat determines the quantity of exhaust gases that can flow from pipe 24 to pipe 32 and thence into the intake manifold 14.

Figure 2:
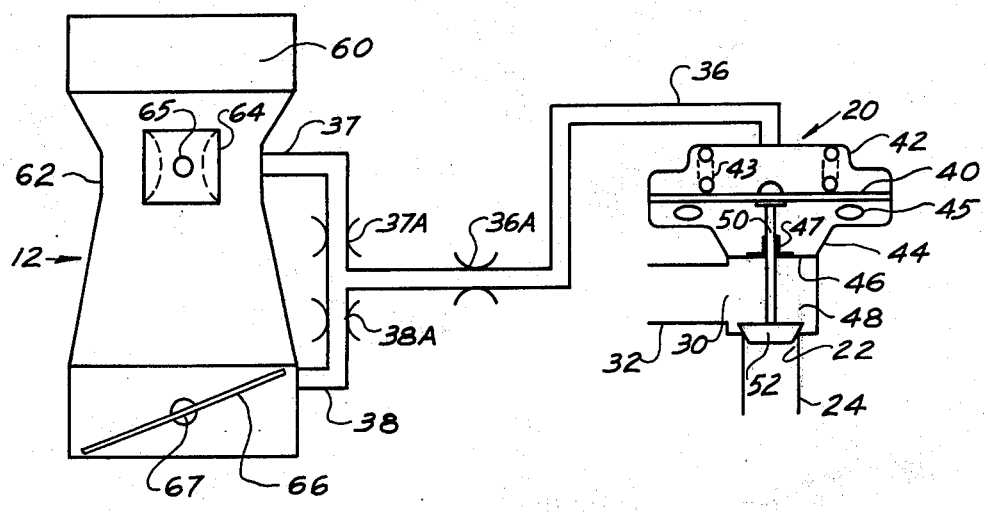
FIG. 2 is a representation of a carburetor showing the port relationship of the two sensing ports and piping to connect same to an exhaust gas recirculation valve.

FIG. 2 shows the essential portions of carburetor 12 to illustrate the invention in use. Carburetor 12 has an air entrance horn 60, a main venturi section 62, a small boost venturi 64, having a main fuel nozzle 65. The carburetor is also provided with a throttle plate 66 mounted on a throttle shaft 67. Although most carburetors are equipped with many additional features, such as an idle fuel system, a float control fuel bowl, choke and other features, such features are not shown in order to simplify the description of the invention.

As mentioned earlier, a negative pressure is required in pipe 36 in order to move diaphragm 40 and thus open the valve 52 to allow the passage of exhaust gases to the intake manifold. This negative pressure is derived from the carburetor at two different locations and in somewhat different ways. Pipe 38 communicates with the bore of the carburetor at a point adjacent one edge of throttle plate 66. When throttle plate 66 is nearly closed, as in the curb idle position, pipe 38 communicates with the bore of the carburetor at a point slightly above the upper edge of the throttle. In this manner, when the throttle is closed or nearly closed, the pressure sensed by pipe 88 is substantially atmospheric pressure and there is no negative pressure derived from that pipe. However, when the throttle plate is opened slightly, pressure existing in the manifold is then sensed by pipe 38 and this being a negative pressure, creates a negative pressure in pipe 38 and this is also transmitted to pipe 36. Another point of sensing negative pressure is at the main venturi 62 where pipe 37 joins the carburetor body. At low air flows, the negative pressure created by air flow through the main venturi is negligible. At higher air flows, the negative pressure created in the throat 62 of the carburetor becomes sustantial. In this manner, there is made provision for sensing two different negative pressures, one by way of pipe 38, the other by way of pipe 37. When the throttle valve is at or near the wide open throttle position, the actual or static pressure existing at pipe 38 is very nearly the pressure existing in air horn 60 or, in other words, very nearly atmospheric pressure. However, during wide open throttle conditions, air flow is high and the negative pressures sensed at the point where pipe 37 communicates with the venturi restriction 62 is very large.

From the foregoing, it will be seen that when the engine is operating at curb idle conditions there is no negative pressure sensed by pipe 37 or pipe 38, and thus, there is no movement of diaphragm 40 and valve head 52 is seated so that no exhaust gas will flow through the exhaust gas recirculation valve. Once throttle plate 66 is moved away from the curb idle position, a negative pressure exists in pipe 38 and this is transmitted to pipe 38 to actuate the valve. With further opening of the throttle valve 66, negative pressure in pipe 37 increases and at wide open throttle the negative pressure in pipe 38 essentially disappears.

Accordingly, it is seen that the negative pressure in pipe 38 is a constantly varying quantity and, in a similar manner, the negative pressure in pipe 37 is a constantly varying quantity. Since these two pipes 37 and 38 are joined together to merge into pipe 36, the resultant negative pressure to pipe 36 comes from the combining of the two separately sensed negative pressures. It is also to be mentioned that at various times both pipe 38 and pipe 37 can permit the entry of air and each of these pipes can also bring about the evacuation of air from pipe 36.

The reason for the entry and evacuation of air in pipes 37 and 38 is that there can be a differential pressure existing as between the two pipes. Thus, when the throttle plate 66 is slightly open and manifold vacuum is exerted on pipe 38, low air flow exists in the carburetor and pipe 37 senses a pressure that is only slightly below atmospheric. Under these conditions, air can enter pipe 37 and flow downwardly toward pipe 38. Under wide open throttle conditions, the pressure existing at pipe 38 is only slightly below atmospheric pressure, but because of the reduced pressure that exists in a venturi during high air flow rates, the pressure in pipe 37 will be substantially below atmosphere. Thus, under those conditions, air can enter in pipe 38 and flow in the direction of pipe 37.

In order that the subatmospheric pressures in pipes 37 and 38 can be properly combined to create the desired resultant pressure in pipe 36, pipe 37 is provided with a restriction **37*a*, pipe 38 is provided with a restriction 38*a* and pipe 36 is provided with a restriction 36*a*. These several restrictions can be sized, usually through trial and error methods, to produce a control signal on diaphragm unit 20** that meets any given set of requirements for any given engine.

Figure 3:
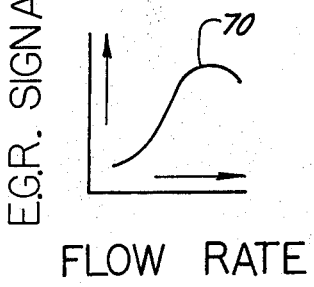
FIG. 3 is a graph of a signal derived by a prior art type installation.

Referring to FIG. 3, there is plotted the flow rate of recirculated exhaust gases verses the subatmospheric signals sensed at pipe 38 during the normal operaton of the carburetor. No numerical figures are given since the signal strength and flow rate are relative. With throttle valve 66 closed, the signal at pipe 38 is essentially atmospheric and there is little or no flow of exhaust gases through diaphragm valve 20. As throttle plate 66 is rotated toward the open position, the subatmospheric pressure sensed in pipe 38 rises rapidly as shown in curve 70 and as the throttle approaches the wide open position, the subatmospheric pressure drops markedly and the flow rate begins to diminish.

Figure 4:
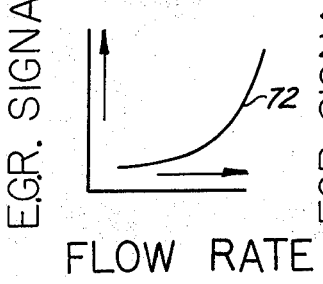
FIG. 4 is a graph of a signal derived by another prior art installation.

FIG. 4 is similar to FIG. 3 excepting that the curve 72 is representative of recirculated exhaust gas flow rate as a function of the subatmospheric pressure sensed at pipe 38 alone. Curve 72 demonstrates that when air is flowing at low volumetric rates through the carburetor 12, the subatmospheric pressure created in the venturi 62 is minimal and the signal transmitted to valve 20 is such as to create little or no opening of the valve and the flow rate is at a minimum. As air flow through the carburetor increases, the subatmospheric pressure sensed by pipe 37 represents a stronger signal and diaphragm 40 is pulled upwardly as a result of this event. Thus, as shown in FIG. 4, the exhaust gas recirculation rate increases as air flow through the carburetor increases.

Figure 5:
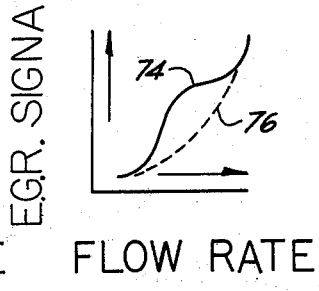
FIG. 5 is a graph of the signal that can be obtained with the present invention.

Flow rate curves 70 and 72 as shown in FIGS. 3 and 4 do not represent the best possible control of exhaust gas recirculation. In FIG. 5, there are shown a pair of flow rate curves 74 and 76. The curve 74 is somewhat like the curve 70 of FIG. 3 and the curve 76 is somewhat like the curve 72. Through the adjustment of restrictions 37*a*, 38*a* and 36*a*, it is possible to shift the curves 74 or 76 to any intermediate position between those shown so that the exhaust gas recirculation rate will be in accordance with a predetermined program to give best engine performance and yet effect a primary purpose of reducing NOX formation during the combustion process in the engine.

From the foregoing description of the invention, it will be apparent to one skilled in the art that the size and location of the entrances for pipe 37 and 38 into the carburetor can be selected to achieve the purpose of controlling exhaust gas recirculation in any desired manner and that the restrictions 37*a*, 38*a* and 36*a* can be sized to shape the curve to any predetermined shape as required for any given engine.

As just mentioned, the restrictions 37*a*, 38*a* and 36*a* can be sized to shape the curve of the flow of exhaust gas through the recirculation valve. When proper selection of these restrictions is made, the flow rate will follow the curve shape of FIG. 5 from curb idle conditions out to a part throttle mode of operation where the quantity of exhaust gas being recirculated approaches a maximum. However, when the throttle is moved to a wide open position, then a substantial negative pressure exists at pipe 37 and a very nearly atmospheric pressure will exist in pipe 38. Under these conditions, there will be back bleeding of air from pipe 38 through restrictions 38*a*, 37*a* into pipe 37 and this results in a greatly reduced negative pressure in pipe 36. Under this condition, diaphragm 40 will move downwardly to shut off or nearly shut off the flow of exhaust gases through pipes 24 and 32. In this manner, one of the original objectives of the invention is fully satisfied. Namely, little or no flow of exhaust gases through the recirculation system at curb idle and at wide open throttle.

What is claimed is:

1. In an internal combustion engine having an intake manifold for conducting an air/fuel mixture to the cylinders or said engine, an exhaust manifold for conducting products of combustion away from said engine, a carburetor having an air/fuel mixing passage, a constricted venturi section in said passage, a throttle valve for controlling the quantity of mixture delivered to said intake manifold and an exhaust gas recirculation system for recirculating a controlled volume of exhaust gases from said exhaust to said intake manifold, the improvement comprising:

A. A vacuum controlled exhaust gas recirculation valve having an inlet port connected to said exhaust manifold and an outlet port connected to said intake manifold, B. a vacuum line connected at one end to the said valve and at its other end to a branched passage, C. said branched passage having a first branch connected to a port in said venturi section and a second branch connected to a port in said carburetor immediately above said throttle, said branch passages conducting a pressure from each of said ports to said vacuum line whereby a resultant combined pressure is imposed on said vacuum controlled valve.

2. The system of claim 1 in which at least one of said first and said second branch passages is further provided with a flow restriction, said restriction serving to regulate the subatmospheric pressure effect of said passage on said vacuum line.

3. The system of claim 1 in which said vacuum line includes restriction means for regulating the rate of application of subatmospheric pressure from said branched passages to said vacuum controlled valve.

4. The system of claim 1 in which said first and second branched passages and said vacuum line are each provided with flow restrictions.

* * * * *